US005540788A

United States Patent [19]

Defalco et al.

[11] Patent Number: 5,540,788

[45] Date of Patent: Jul. 30, 1996

[54] METHOD OF PREPARING IRON-PHOSPHATE CONVERSION SURFACES

[75] Inventors: Frank G. Defalco, Houston; Charles R. McCoy, Pearland, both of Tex.

[73] Assignee: Mdechem, Inc., Houston, Tex.

[21] Appl. No.: 393,664

[22] Filed: Feb. 24, 1995

[51] Int. Cl.[6] ..... C23C 22/07

[52] U.S. Cl. ..... 148/246; 148/261; 148/262

[58] Field of Search ..... 148/246, 262, 148/261

[56] References Cited

U.S. PATENT DOCUMENTS 5,084,263 7/1989 McCoy ..... 423/184
5,310,419 5/1994 McCoy ..... 423/184

*Primary Examiner*—Sam Silverberg
*Attorney, Agent, or Firm*—John R. Kirk, Jr.; Jenkens & Gilchrist

[57] ABSTRACT

The present invention provides for forming an iron-phosphate conversion surface, or an iron-phosphate bi-metallic surface on metals, in situ, in internal combustion engines, pumps, hydraulic systems, compressors and other mechanical equipment and machinery, using the lubricating oil as the medium for bringing the phosphate and bi-metallic inorganic polymeric water complexes into contact with the metals in the machinery. The inorganic polymeric water complexes can be formed in accordance with U.S. Pat. Nos. 5,084,263 and 5,310,419 which are incorporated herein by reference. The bimetallic component can be any metal from Classes I through VIII of the Periodic Table. The phosphate and/or phosphate bi-metallic complexes are added to the lubricating oil while the engine is running. The iron-phosphate film that is formed reduces co-efficient of friction, reduces metal wear and extends engine life, increases mileage, reduces hydrocarbon emissions, and extends oil drainage intervals on all lubricated machinery and equipment.

8 Claims, 1 Drawing Sheet

METHOD OF PREPARING IRON-PHOSPHATE CONVERSION SURFACES

BACKGROUND OF THE INVENTION

Iron/phosphate conversion surfaces were first discovered in 1869 in England and a Patent was granted under the English Patent Laws. There then followed a series of improvements on the basic process. These improvements allowed for faster conversion rates, better cleaning procedures, and addition of other metal ions such as zinc, manganese, or nickel etc., to achieve an iron-phosphate coating with a bi-metallic element such as zinc-phosphate or manganese phosphate. These bi-metallic phosphate surfaces gave different properties which enhanced the usefulness of the iron-phosphate surface.

There is an extensive amount of literature on phosphatizing, mostly contained in patents issued on phosphating processes. In 1969 METAL FINISHING presented abstracts of 522 patents issued on phosphatizing processes.

Iron/phosphate surfaces and their derivatives became one of the most widely used surfaces for industrial applications in the world. The iron/phosphate conversion surfaces have excellent keying points for retention of paints and are widely used as an undercoat for paints in truck and car bodies, file cabinets, shipping containers, and many other uses as a paint undercoat.

Additionally, the iron-phosphate surface provides excellent corrosion protection to prevent oxidation of steel parts. The iron phosphate surface has a lower co-efficient of friction than steel, and provides dry film lubricity on moving and sliding steel parts. The surface also has excellent retention of oil properties which enhance the lubricating effect of oils.

The application techniques of a phosphating line include baths for removing all soils and oils from the steel surfaces in order for the conversion to occur. It is well known in the art that the preparation of the metal surface, particularly the removal of oils, is required in order for the conversion process to occur. A brief description of a phosphatizing system consists of a hot alkaline bath to remove oils, a rinse tank, then an acid bath to remove oxidation, a rinse tank, then a phosphatizing tank maintained at an elevated temperature. Phosphatizing is a lengthy process with strictly controlled parameters throughout the operation in order to achieve the desired surface.

Many of the small parts in internal combustion engines have been given iron-phosphate conversion surfaces such as cams, tappets, piston rings. Phosphatizing of these parts did not achieve universal acceptance in the automotive or other industries due to the added costs.

Organic phosphate compounds have also been widely used as additives in lubricating oils to impart EP (Extreme Pressure) properties to oils. It has been demonstrated that some of the organic phosphates had, over time, burnished into gears and other metal moving parts and have provided good metal protection. This burnishing in of phosphates to metals occurred in a spotty, inconsistent, and uncontrollable manner thus limiting the pursuit of this application in machinery and equipment.

In attempts to improve lubricating properties many additives have been added to motor oils to improve lubricity. A whole range of of compounds have been used, including PTFE (TEFLON™ of DuPont) molybdenum di-sulfide compounds, halogenated hydrocarbons, and colloidal suspensions of metal salts of lead, or copper or zinc. All of these additives either were ineffective or created problems within the engines that were supposed to benefit from the additives. The most widely used additive, PTFEs and their isomers, have been widely discredited in several scientific studies. Molybdenum di-sulfides presented problems with fouling of oil filters. Lead was a very effective additive; however, the toxicity of lead and severe environmental problems precluded lead's further use as an additive. Halogenated hydrocarbons present environmental problems and can create corrosion problems in engines.

Race car drivers spend thousands of dollars per engine to increase horsepower for better performance. The addition of 1 or 2 horsepower to an engine is, in many cases, the difference between a winning race and being an also ran. To accomplish any increase in horsepower engines are disassembled then may be chrome plated, or be ceramic lined, or have other type of metallic surfaces applied to moving parts to reduce friction. Such treatments are very expensive and can cost thousands of dollars for the engine treatment.

It has long been recognized that an inexpensive method of achieving an iron-phosphate conversion surface on all sliding, moving metal parts in engines, pumps, gearboxes, etc., would result in enhanced performance characteristics for the equipment. The enhanced performance would result from the reduction of friction, thereby reducing energy consumption, and enhancing the performance of lubricating oils. A process which would achieve an inexpensive iron/phosphate surface, specifically by achieving an iron/phosphate surface in the completed machinery engines, would be extremely valuable; for instance an internal combustion engine will have over 200 parts in cams, lifter, cylinders, timing chains. By applying a friction reducing surface to the parts internal combustion engines race car drivers enhance horsepower, fuel usage and better cooling of the engines.

SUMMARY OF THE INVENTION

In U.S. Pat. No. 4,533,606, the inventors describe a novel process for obtaining a zinc/phosphate surface, by electrodeposition, on all conductive substrates. In U.S. Pat. No. 5,310,419 incorporated herein by reference the inventors describe methods of preparing novel, water based polymeric complexes which would have wide utility in many areas including electroplating of metals. One of the complexes described was a phosphate/nitrogen/potassium and/or sodium electrolyte that could be used to electrolytically deposit gold and silver on conductive substrates a theretofore unknown phenomenon. It was also observed in U.S. Pat. No. 5,310,419 that this phosphate/nitrogen/potassium complex had the property of being able to remove oils from steels.

Since it is well known in the art by those skilled in metal finishing that a phosphate conversion surface cannot be obtained with an oil film enveloping a metal, the idea of phosphatizing through an oil bath was not obvious. Literature on phosphatizing teaches that such a result would not occur on an oily surface.

DETAILED DESCRIPTION OF THE INVENTION

Figure 1:
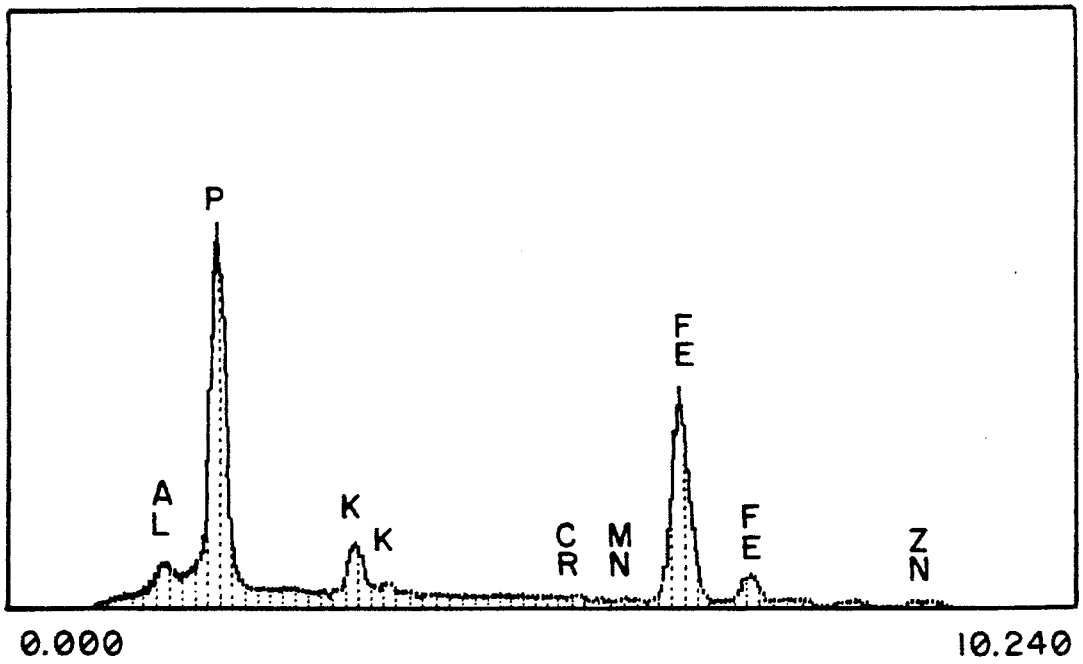
FIG. 1 is an EDAX Analysis of the surface of a Timken bearing treated in accordance with Experiment VIII showing the composition of such surface.

In running an experiment on the removal of oil from metal the following occurred: A phosphate/nitrogen/potassium solution was prepared and stooped at a Ph approaching 7. A polished 1010 steel rod, ¼×3", was immersed in 18 API gravity black crude oil. The rod was then immersed in a clear glass bottle that contained the electrolyte. The next morning, 18 hours later, the oil had been completely removed from the polished peg, and the steel peg had acquired a characteristic grayish black phosphate appearance. This characteristic color was indicative of an iron/phosphate conversion surface. The steel peg was withdrawn, thoroughly wiped with a paper towel, rinsed and dried. The surface was still present and could not be removed by the classic fingernail and scotch tape tests for coating adherence. An ohmmeter reading indicated that the steel peg would not support a current; again, a further indication of an iron/phosphate surface. The presence of the iron-phosphate surface was indeed surprising. This was the first indication that an iron phosphate surface could form through an oil barrier.

EXHIBITS

Exhibit I The bearing from Experiment VIII was examined on an EDAX.

Exhibit II—are the results from a dynamometer test on chevrolet Rebuilt performance engine run at Kim Barr Racing Engines, Garland, Tex. Torque and horsepower were measured before and after treatment. Increase in foot pounds of torque and horsepower were measured both as to amount and percentage. The treatment with the inorganic polymeric water complex produced significant increases in both torque and horsepower on a newly reworked high performance engine.

Exhibit III are results obtained on emission tests perforated on six different vehicles before treatment with the inorganic polymeric water complex compared with results after treatment with the inorganic polymeric water complex. All vehicles tested showed decreases in hydrocarbon and carbon monoxide emissions.

Two solutions were prepared in accordance with U.S. Pat. No. 5,310,419 in open reactors as follows:

| | QUANTITY | |
|---|---|---|
| ITEM | SOLUTION ONE | SOLUTION TWO |
| AMMONIUM HYDROXIDE | 1000 ML. | 1000 ML. |
| POTASSIUM HYDROXIDE | 1000 ML. | — |
| SODIUM HYDROXIDE | — | 800 ML. |
| DEIONIZED WATER | 1000 ML | 1000 ML |
| PHOSPHORIC ACID 75% | 1000 ML. | 1000 ML |

adding one liter of ammonium hydroxide to a reactor vessel; adding thereto one liter of potassium hydroxide; mixing in a separate vessel one liter of deionized water with one liter of 75% phosphoric acid and then adding to the ammonium-potassium mixture; stopping the reaction at a Ph approaching 7. This end product #1, was used for further experimentation. Product two was prepared in the same method as Product one, and is referred to as #2 in further experimentation.

EXPERIMENT I

A polished 1010 steel peg, as above, was immersed in 18 API gravity black crude and then immersed in a clear 4 ounce bottle of Solution #1. Temperature was 72 F. Again, the oil was removed and an iron-phosphate surface was present after 18 hours.

EXPERIMENT II

A piece of 1010 steel plate, ½"×2" was immersed in crude oil and placed in a clear 4 ounce bottle with Solution 2. Temperature was 72 F. and at the end of 18 hours the characteristic iron-phosphate surface was present on the metal.

EXPERIMENT III

A standard, polished Timken bearing was immersed in crude and placed in a clear bottle containing Solution #1. Temperature was ambient. In less than 12 hours the bearing had an iron-phosphate conversion coating.

EXPERIMENT IV

An emulsion was created by mixing together 2 ounces of Exxon Uniflo motor oil with 2 ounces of solution #1, and shaking vigorously until the oil/water was completely emulsified. A polished Timken steel bearing and a polished 1010 steel rod were then immersed in the emulsion. The emulsion separated slowly and the reaction observed. There was a slow evolution of hydrogen on the metal surfaces and a darkening of the metal occurring indicating the conversion process was occurring. The phosphate conversion was visible and occurred over a period of 3 hours.

These experiments were conducted to validate the surprising, heretofore unknown phenomena, that an iron/phosphate surface would occur in the presence of oil and that oil could actually be used as a carrier for the phosphate to the metal surface.

Further experiments were then conducted using A Falex Lubricity Tester to run the ASTM Standard Timken Bearing tests with standard motor oils. Pennzoil 10W40 and Exxon Uniflo 20W50 were selected as the standard motor oils. Standard Timken bearing blocks and rings were used. The test procedures consisted of putting the standard weight motor oils in the reservoir; inserting the bearings in a holding arm; the bearing was then held against the rings by a fulcrum that forced the bearing against the race rings; turning on the testing machine at a speed of 1,200 RPM; then incrementally adding two pound weights to the fulcrum until friction "locked up" the test specimens. The scars created by friction were then measured in millimeters (mm) and compared with a published chart. The chart correlates pounds of weight added to the fulcrum with the length of the scar in mm on the bearing that gives a calculated weight bearing load in pounds per square inch (PSI) of pressure.

EXPERIMENT V

Ten ml of the Pennzoil 10W40 were placed in the reservoir of the Falex tester. A standard Timken bearing was inserted in the holding clamp and placed against the race. The Tester was turned on and two-pound weights were added incrementally on the back of the fulcrum. When the third weight was added, the machine locked up and was turned off. The bearing was extracted and the scar observed and measured. The scar was 8 mm in length indicating a load carrying capacity of Pennzoil of approximately 4500 PSI.9

EXPERIMENT VI

The bearing used in EX. V was reinstalled in the holder and the scar rotated 90 degrees from the race. The oil present in the reservoir was used, The machine was turned on. Two ml of the mother liquor was added to the oil in the reservoir and an emulsion formed. The bearing was placed against the race and the machine was turned on. After one minute two-pound weights were added incrementally until a total of 12 pounds of weights had been added to the fulcrum. The machine was stopped and started under full load. The machine was then stopped and the bearing and the race were examined. The scar on the bearing was measured at 1 ml., indicating a load carrying capacity of 427,000 PSI. There was a characteristic iron/phosphate surface on the portion of the bearing which had been immersed in the emulsion. The race was wiped with a cloth and the characteristic iron-phosphate surface was present on the race surface. This experiment demonstrated not only that the iron-phosphate surface, contrary to all the known literature, could be formed in the presence of oil, but that the oil itself took on super lubricating properties.

EXPERIMENT VII

The reservoir was cleaned of oil and fresh oil was then placed in the reservoir. The bearing was rotated 90 degrees, where an iron/phosphate surface was had formed. The bearing was then placed against the race and the machine started. Two-pounds weights were added incrementally until a total of 14 pounds of weight were on the fulcrum. The machine was stopped and started several times under the full load. The bearing was extracted and examined. The scar was less than 2 mm indicating a weight carrying load of 500,000 PSI for the oil when the iron-phosphate film was present on the moving metal parts. This experiment shows that once the iron-phosphate surface forms, that it is permanent surface for reducing coefficient of friction so drastically thaft an ordinary motor oil which could only carry 4500 PSI of weight is converted into a super lubricant.

It was postulated that the reduction in friction caused by the iron-phosphate surface would cause a significant reduction in heat in internal combustion engines which would translate into increased engine life, increased energy efficiency by increasing the miles per gallon, and a longer lasting lubricant life.

EXPERIMENT VII

The Ph of solution #1 was adjusted by adding 10 ml of 75% phosphoric acid to 10 ml of the #1 to arrive at a Ph below 3. Fresh motor oil was placed in the tester reservoir, a bearing was placed in the holder and the machine turned on. Two ml. of Ph 3 solution was added to the oil and an emulsion formed. Then eight 2-lb. weights were added incrementally to the fulcrum. After two minutes the tester was stopped. Trace and bearing were examined. Both parts had a dark, denser iron-phosphate surface when compared with the 7 Ph solution. The scarring effect was roughly the same, with a 1 mm scar on the bearing. This experiment indicates that by varying Ph readings denser iron-phosphate surfaces can be achieved.

EXPERIMENT VIII

Ten ml. of solution #2 was adjusted to a Ph below 3 by adding 10 ml of 75% phosphoric acid to 10 ml. of #2. Then one milligram of zinc oxide was dissolved in the solution. Ten ml of fresh oil was added to the test reservoir. A fresh Timken bearing was used and the machine was turned on. Two ml of the zinc phosphate solution was added to the oil and emulsion formed. A total of 18 pounds of weights were added incrementally to the fulcrum. The machine was operated for two minutes and then turned off. The bearing and the race were then wiped clean of oil and examined. The scar on the bearing was calculated to be one mm. The surface showed a definite zinc-phosphate surface with a bright, burnished clear surface on the scar. This experiment demonstrates that metal ions could be incorporated into the electrolyte solutions and be co-deposited on metals through an oil reservoir. This led to the postulate that other metals could be co-deposited using the newly discovered method of depositing surface on sliding metal parts using an oil reservoir. The surface was analyzed by Electron Dispersive Analytical Xray in Exhibit I.

EXPERIMENT IX

Two ounces of solution #1 was combined with 2 ounces of 75% phosphoric acid to achieve a Ph below 3. Ten mg. of molybdic acid was dissolved in the solution. A piece of 12 gage 1010 steel, 1"×3" in surface, was immersed in the solution for 10 minutes and extracted. A new surface was present on the metal. A propane torch was and the flame tip was held against the metal. Surprisingly, the thin piece of steel did not burn through as would be expected; instead the purplish characteristic color of molybdenum appeared on the surface. The metal piece could be held by hand away from the flame, indicating superior heat dissipation.

The results of this experiment were very surprising. First, molybdenum is a refractory metal and cannot be electroplated in its pure state. Molybdenum can only be electrolytically co-deposited. Thus to find molybdenum present on the surface of steel without the use of applied electromotive force in not taught in the literature. The benefits of a co-deposited phosphate/molybdenum surface on metal parts in internal combustion engines can be speculated. Molybdenum has a very low coefficient of friction, is an excellent corrosion inhibitor in a reducing atmosphere such as an oil reservoir, has superior heat dissipation properties, and is widely used as a dry film lubricant. All of these known properties of molybdenum would enhance performance of internal combustion engines, resulting in reduced friction, heat dissipation and corrosion protection.

EXPERIMENT X

A bottle of Canola oil was purchased from a local store. Canola oil has some lubricating properties, but does not have the standard additive packages that go into motor oils, such as surfactants, corrosion inhibition, EP additives, etc. Thus the dry film lubricating properties of the molybdenum could be tested without the beneficial properties added to motor oils. Ten ml of canola oil was placed in the Falex reservoir, a new Timken bearing was installed in the holder and the machine turned on. Two ml. of solution from experiment IX were put into the oil and an emulsion formed. Six pounds of weights were added to the fulcrum incrementally and the machine was operated for two minutes. The race and the bearing were examined and a coating with dark purplish hue was present on the surface of both parts. A scar of 1 mm was measured, indicating superior lubricating properties. The reservoir was then emptied of oil and fresh canula oil added to the reservoir. The bearing was then placed against the race and the machine started. Eighteen pounds of weights were added incrementally to the fulcrum. The machine was run for three minutes. At no time was there any indication that the canula oil would break down. The temperature in the oil reservoir did not rise above 150 F., indicating an almost total absence of friction on the sliding parts. The bearing was extracted, cleaned and The scar measured at less than 1 mm or a load carrying capacity in excess of 500,000 PSI. As canula oil has a load carrying capacity of 4,000 PSI, the 100,000% increase in load carrying is directly attributable to the formation of the dry film molybdenum-phosphate surface on the metal.

EXPERIMENT XI

Two ounces of solution #2 was adjusted to a Ph below 3 with phosphoric acid. 10 grams of ammonium paratungstate was dissolved in the solution. A new Timken bearing was installed in the holder and the lubricity tester was turned on with Exxon Uniflo in the reservoir. Two cc of tungsten phosphate solution was added to the reservoir, an emulsion formed, and 10 pounds of weight were added to the fulcrum. The machine was run for three minutes under load and then turned off. The surfaces of both the bearing and race were examined and the scar measured at less than 2 mm. The scar was brightly polished, had a mirror finish approaching that of rhodium. This experiment indicates that other refractory metals can be used to form bi-metallic surfaces using an oil reservoir as the carrying agent.

EXPERIMENT XII

A 1982 ISUZU Diesel pickup truck with a 4 cylinder engine and 145,000 miles on the engine was chosen as a test vehicle. The engine contained 6 gallons of lube oil. The miles per gallon of fuel usage was calculated at 36 MPG over the previous two month period. A total of 8 ounces of the Solution #1, adjusted to a Ph of 3, was added to the oil crankcase while the engine was running. There was a noticeable decrease in the sound level of the engine within two minutes. The MPG average was then calculated over a period of 10,000 miles of driving. The MPG obtained by the vehicle now reached 42.4 MPG, an increase of 18% in fuel economy, a significant savings. The oil and filter were changed after 12,000 miles. The car continued to average approximately 42 MPG indicating a permanent, friction reducing film on the engine parts. It is well known that the presence of water in engine oil has a deleterious effect on the oil. Amounts of 1/10Th of 1% in lubricating oils will usually cause engine failure. Thus the fact that the engine did not seize,but actually enhanced the performance of the engine was not obvious and very surprising.

EXPERIMENT XIII

A lawn mower, with a 4 cycle Tecumseh mower was used. One ounce of solution #1 was used and poured into the oil reservoir. There was an immediate and noticeable decline in the level of noise. The mower was then operated for several operations over a three week period, and an increase in the amount of square of grass being cut with one gallon of gasoline was noticed. Normally, one gallon of gas would cut approximately 20,000 square feet of grass; with the addition of the solution #1 the amount of grass being cut with one gallon of gasoline was calculated to be 30,000 square feet, an increase in efficiency of 50%.

EXPERIMENT XIV

A 1988 Chevrolet Suburban was used. The owner had averaged 13 MPG in city driving and 16 MPG in highway driving. The vehicle had 112,000 miles of usage on the engine. Eight ounces of solution, adjusted to a Ph of 3, and containing molybdic acid was added to the crankcase. The vehicle was then driven on two extended trips of over 2,000 miles. The MPG usage on these tripe was approximately 20 MPG, indicating an increase in energy efficiency of 25%. A drop in operating temperature from 180 F. to 150 F. was also a result of the engine treatment.

EXPERIMENT XV

A 1974 Mercedes Benz 300D, with 210,000 miles on the engine was treated with 8 ounces of Solution #1, adjusted to a Ph of 3 and containing molybdic acid. Average MPG was calculated at 18 MPG in city driving. After 1000 miles the MPG average increased to 22 MPG.

EXPERIMENT XVI

A 1982 Cadillac Coupe de Ville with 141,00 miles registered on the speedometer was used. The engine was running hot and had difficulty in idling without stopping. Eight ounces of the solution #1, adjusted to a Ph of 3 and containing molybdic acid was placed in the crankcase. The car was allowed to idle and the temperature within two minutes and the motor could then idle without stalling. The operator reported an estimated 20% increase in MPG.

EXPERIMENT XVII

A 1986 Ford Pickup with a 310 cc engine was used. Six ounces of the Solution 2 adjusted to a pH of 3 and containing molybdic acid was placed in the crankcase. At 60 MPH the tachometer indicated a reading of 2,000 RPM; after treatment the tachometer reading was 1775 at 60 MPH indicating a significant increase in horsepower.

EXPERIMENT XVIII

A dynamometer test was run on a newly rebuilt high Chevrolet high performance engine. The engine and the test are described in Exhibit II. The results of the dynamometer test showed a significant increase in horsepower in a newly rebuilt engine that theoretically was performing at maximum horsepower. The solution used was the same as that described in Experiment XVI. The torque results were also measured and the test results paralleled the results obtained on the horsepower charts.

EXPERIMENT XIX

A 1974 Volkswagen Van with an air cooled motor had an oil and filter change. A 4 ounce bottle of solution #2, adjusted to pH of 4 was added to the new oil while the engine was running. After ten minutes the mechanic examined the oil by pulling the dipstick. The new oil had changed to a black tar color and was more viscous than the new oil. The oil and filter were immediately changed, and the engine was run for another 10 minutes and reexamined. The oil had maintained it golden color, after 10 minutes and the mechanic reported that the engine ran smoother. This test showed, surprisingly, that an engine could be cleaned of carbon build up of sludge within ten minutes.

EXPERIMENT XX

A series of emissions tests were run on used gasoline engines to test before and after readings of carbon monoxide and hydrocarbon emissions. The results of the tests are summarized in Exhibit III. Decreasing the hydrocarbon emissions from internal combustion engines is a high national priority of Environmental Protection Agency. The solutions used in these tests were the same composition as that used in Exp. XVI. The ability to reduce hydrocarbon emissions in less than 15 minutes was surprising. Reductions in hydrocarbon emissions usually require extensive mechanical work on the engine. Thus a new method of reducing emission on vehicles with internal combustion engines was discovered.

EXPERIMENT XXI

A 1984 Chevrolet Corvette with 82,000 miles was tested for compression ratios, hydrocarbon and carbon monoxide emissions and fuel economy. The results obtained a 3.33% increase in compression ratios, a reduction in carbon monoxide emissions from 0.84% to 0.00%, nd reduction in hydrocarbon emissions from 188 parts per million to 25 PPM; an increase in fuel economy from 22.6 MPG to 25.5 MPG or an increase of 12.*%. The results of the emissions tests are shown in Exhibit III.

The foregoing descriptions of experiments have been directed to particular embodiments of the invention in accordance with the Patent Statutes and for purposes of illustration of manufacture and use. It will be apparent to those skilled in the art that many modifications, changes, and different uses can be obtained from the described experiments without parting from the spirit of the invention. It is the intention of the invention to embrace all such modifications and variations of the basic invention.

EXHIBIT "I"

SSQ:
ANASTAS TECHNICAL SERVICES TUE 20-SEP-94 14:47
Cursor: 0.000 KeV = 0
90 MDEC/FALEX BEARING TEST/NON-WEAR SURFACE
SSQ

SEMI-QUANTITATIVE ANALYSIS:
MDEC/FALEX BEARING TEST/NON-WEAR SURFACE

| EL | NORM. | K-RATIO | |
|---|---|---|---|
| AL-K | 0.02621 | + | −0.00068 |
| P-K | 0.34430 | + | −0.00273 |
| K-K | 0.06123 | + | −0.00125 |
| CR-K | 0.00385 | + | −0.00040 |
| MN-K | −0.00000 | + | −0.00000 |
| FE-K | 0.54187 | + | −0.00544 |
| ZN-K | 0.02251 | + | −0.00149 |

ZAF CORRECTION 25.00 KV 30.00 Degs
No. of Iterations 4

| — | K | [Z] | [A] | [F] | [ZAF] | ATOM. % | WT. % |
|---|---|---|---|---|---|---|---|
| AL-K | 0.026 | 0.971 | 2.573 | 0.986 | 2.466 | 7.11 | 4.87* |
| P-K | 0.344 | 0.973 | 1.688 | 0.997 | 1.639 | 54.06 | 42.50* |
| K-K | 0.061 | 0.977 | 1.421 | 0.989 | 1.375 | 6.42 | 6.35* |
| CR-K | 0.003 | 1.034 | 1.073 | 0.876 | 0.974 | 0.21 | 0.28 |
| MN-K | 0.000 | 1.052 | 1.049 | 0.998 | 1.102 | 0.00 | 0.00 G |
| FE-K | 0.541 | 1.041 | 1.039 | 0.997 | 1.079 | 31.02 | 44.06 |
| ZN-K | 0.022 | 1.057 | 1.082 | 1.000 | 1.144 | 1.18 | 1.94 |

*High Absorbance

EXHIBIT "II"

Kim Barr Racing Engines Dynamometer Testing (Before & After)

| Speed rpm | Torque (Trq) lb-ft Before | Torque (Trq) lb-ft After | Torque (Trq) lb-ft Diff | Torque (Trq) lb-ft % Diff | Power (Pwr) Hp Before | Power (Pwr) Hp After | Power (Pwr) Hp Diff | Power (Pwr) Hp % Diff |
|---|---|---|---|---|---|---|---|---|
| 3,000 | 363.7 | 377.1 | 13.4 | 3.68% | 207.7 | 215.4 | 7.7 | 3.71% |
| 3,250 | 353.3 | 370.5 | 17.2 | 4.87% | 218.6 | 229.3 | 10.7 | 4.89% |
| 3,500 | 355.2 | 382.6 | 27.4 | 7.71% | 236.7 | 255 | 18.3 | 7.73% |
| 3,750 | 368.7 | 386.7 | 18 | 4.88% | 263.3 | 276.1 | 12.8 | 4.86% |
| 4,000 | 369.8 | 389.2 | 19.4 | 5.25% | 281.6 | 296.4 | 14.8 | 5.26% |
| 4,250 | 367.6 | 381.9 | 14.3 | 3.89% | 297.5 | 309 | 11.5 | 3.87% |
| 4,500 | 360.8 | 376.1 | 15.3 | 4.24% | 309.1 | 322.2 | 13.1 | 4.24% |
| 4,750 | 354.1 | 367.6 | 13.5 | 3.81% | 320.3 | 332.5 | 12.2 | 3.81% |
| 5,000 | 338.5 | 353 | 14.5 | 4.28% | 322.3 | 336.1 | 13.8 | 4.28% |
| 5,250 | 323.3 | 334.6 | 11.3 | 3.50% | 323.2 | 334.5 | 11.3 | 3.50% |
| 5,500 | 299.3 | 315.1 | 15.8 | 5.28% | 313.4 | 330 | 16.6 | 5.30% |

EXHIBIT III

Emissions Tests on Gasoline Engines

| No. | Model/Engine/Oil | Year | Miles | | Carbon-Dioxide CO2 (%) | Carbon-Monoxide CO (%) | Oxygen O2 (%) | Hydro-carbons HC (ppm) |
|---|---|---|---|---|---|---|---|---|
| 1 | Ford Bronco II | 1990 | 58,078 | Before | 15.61% | 0.01% | 0.14% | 9 |
| | 4-Cylinder, 2.9 liter | | | After | 15.50% | 0.00% | 0.27% | 1 |
| | Royal Purple Oil | | | Change | −0.11% | −0.01% | 0.13% | −8 |
| | | | | % Change | −0.7% | −100.0% | 92.9% | −88.9% |
| 2 | Ford F150 Truck | 1979 | 73,550 | Before | 13.34% | 0.08% | 3.27% | 37 |
| | 8-Cylinder, 302 cu in | | | After | 14.22% | 0.09% | 2.04% | 29 |

EXHIBIT III-continued

Emissions Tests on Gasoline Engines

| No. | Model/Engine/Oil | Year | Miles | | Carbon-Dioxide CO2 (%) | Carbon-Monoxide CO (%) | Oxygen O2 (%) | Hydro-carbons HC (ppm) |
|---|---|---|---|---|---|---|---|---|
| | Castrol 20-W50 | | | Change | 0.88% | 0.01% | −1.23% | −8 |
| | | | | % Change | 6.6% | 12.5% | −37.6% | −21.6% |
| 3 | Ford F150 Truck | 1988 | 196,602 | Before | 10.49% | 0.30% | 3.27% | 37 |
| | 8-Cylinder, 302 cu in | | | After | 11.03% | 0.00% | 2.04% | 29 |
| | Unknown | | | Change | 0.54% | −0.30% | −1.23% | −8 |
| | | | | % Change | 5.1% | −100.0% | −37.6% | −21.6% |
| 4 | Chev. Pickup Truck | 1977 | 55,250 | Before | 13.12% | 0.03% | 3.54% | 2 |
| | 8-Cylinder, 350 cu in | | | After | 13.69% | 0.12% | 2.73% | 0 |
| | Texaco Havolin 40 | | | Change | 0.57% | 0.09% | −0.81% | −2 |
| | | | | % Change | 4.3% | 300.0% | −22.9% | −100.0% |
| 5 | GMC Pickup Truck | 1991 | 83,908 | Before | 14.94% | 0.13% | 0.00% | 23 |
| | 8-Cylinder, 350 cu in | | | After | 14.93% | 0.13% | 0.00% | 23 |
| | Unknown | | | Change | −0.47% | −0.13% | 0.00% | −16 |
| | | | | % Change | −3.1% | −100.0% | 0.0% | −69.6% |
| 6 | Chevrolet Corvette | 1984 | 69,357 | Before | 10.70% | 0.86% | 6.27% | 188 |
| | 8-Cylinder, 350 cu in | | | After | 11.89% | 0.00% | 5.36% | 25 |
| | Castrol | | | Change | 1.19% | −0.86% | 0.91% | −163 |
| | | | | % Change | 11.12% | −100.0% | −14.51% | −86.70% |

Tests #1–4 performed: 11/11/94 at Martin Motion, 14518 Hempstead Hwy, Houston, TX 77040 (713) 690-3673
#5 performed: 11/17/94 at Precision Tune, 3155 S. Padre Island Drive, Corpus Christi, TX 78415 (512) 852-2708
#6 performed: 01/20/95 at Corvette Techniques, 10050 W. Gulf Bank Ste 210, Houston, TX 77040 (713) 849-2283

The subject matter the Applicants claim as their invention is:

1. A method of forming an iron-phosphate conversion surface on metal components in a lubricating environment by using the lubricating medium as the phosphating bath for obtaining the desired deposit comprising providing;

a. A source of phosphoric acid;

b. An alkali metal hydroxide;

c. A source of reactive NH2 groups; forming an inorganic polymeric water complex prepared as follows;

(i) mixing in an aqueous medium said source reactive NH2 groups with a) said alkali metal hydroxide to raise the Ph of the solution above 12 to form an aqueous ammonium/alkali metal hydroxide; or b) said source of phosphoric acid to lower the pH to about 0 to form an acidic ammonium mixture; and ii) combining the mixture of step (i.a.) with said source of phosphoric acid; or the mixture of (i.b.) with said hydroxide at a rate sufficient to create a highly exothermic reaction, whereby the reactive NH2 groups are contained in solution during the formation of the inorganic polymeric water complex; and iii) adding said inorganic polymeric water complex obtained from step ii), by pouring slowly into a lubricating oil; creating an emulsion; contacting metal parts with said emulsions to form an iron/phosphate conversion coating.

2. The method of claim 1, where the pH of the inorganic polymeric water complex is lowered by the addition of a mineral acid or a carboxylic acid.

3. The method of claim 1 wherein zinc metal ions introduced to the inorganic polymeric water complex, either before or after the exothermic reaction, to form a zinc/phosphate/alkali metal complex.

4. The method of claim 1 wherein molybdenum metal ions are introduced into the inorganic polymeric complex, either before or after the exothermic reaction, to form a molybdenum/phosphate/alkali metal inorganic polymeric complex.

5. The method of claim 1 wherein tungsten metal ions are introduced into the inorganic polymeric complex, either before or after the exothermic reaction, to form a tungsten/phosphate/alkali metal inorganic polymeric complex.

6. The method of claim 1 wherein a source of metal ions from Group 1 through Group 8 of the Periodic Table are introduced into the inorganic polymeric water complex, either before or after the exothermic reaction, to form a metal/phosphate/alkali metal inorganic polymeric complexes.

7. The method of claim 1, claim 2, claim 3, claim 4, claim 5, and claim 6, wherein a water soluble glycol in introduced into the solution containing the inorganic polymeric water complex.

8. The method of claim 1 wherein the lubricating oil is in a reservoir of an engine or motor and running said engine or motor to create said emulsion and to contact moving and siding parts of said engine or motor with said emulsion.

* * * * *